US007316344B2

(12) United States Patent
Smith

(10) Patent No.: US 7,316,344 B2
(45) Date of Patent: Jan. 8, 2008

(54) DIVIDED STORAGE SYSTEM

(75) Inventor: Scott D. Smith, Hernando, MS (US)

(73) Assignee: Advantus Corp., Jacksonville, FL (US)

( * ) Notice: Subject to any disclaimer, the term of this patent is extended or adjusted under 35 U.S.C. 154(b) by 0 days.

(21) Appl. No.: 11/232,731

(22) Filed: Sep. 22, 2005

(65) Prior Publication Data

US 2007/0062833 A1 Mar. 22, 2007

(51) Int. Cl.
*B26D 5/42* (2006.01)
*B65D 85/00* (2006.01)

(52) U.S. Cl. ..... 229/198.1; 206/425; 229/67.3

(58) Field of Classification Search ..... 206/425, 206/736, 745; 220/528–530; 229/67.1–67.4, 229/117.05, 190–194, 198, 198.1, 120.06, 229/120.09, 120.11; 312/258, 259
See application file for complete search history.

(56) References Cited

U.S. PATENT DOCUMENTS 1,676,872 A * 7/1928 Schurmann ..... 229/198
2,032,373 A * 3/1936 Mellars et al. ..... 229/198
2,519,405 A * 8/1950 Schwinger ..... 229/67.3
2,704,184 A * 3/1955 Martin ..... 229/67.1
3,645,437 A * 2/1972 Giebel et al. ..... 206/425
4,549,688 A * 10/1985 Ozmon et al. ..... 229/67.3
4,958,728 A * 9/1990 Effendi ..... 206/425
5,815,903 A * 10/1998 Foster et al. ..... 206/425
5,823,424 A * 10/1998 Allen ..... 229/198
7,147,142 B1 * 12/2006 Chang ..... 229/67.3

* cited by examiner

*Primary Examiner*—Luan K Bui
(74) *Attorney, Agent, or Firm*—Arthur G. Yeager

(57) ABSTRACT

A divided storage system is formed of a collapsible container and a collapsible divided file assembly. The container includes a planar blank having a centrally-located bottom panel with four side portions, four side panels each foldably attached to a respective one side portion and movable to a position perpendicular to the bottom panel fasteners are carried by each side panel for attaching the side panels together to define an interior space. The file assembly includes files each locatable adjacent to the side panel and removably attachable thereto. The file assembly includes a plurality of file dividers located between the first and second files and are connected via accordion pleats. The first and second files include outwardly extending tabs with passageways therethrough and are attached to the container by being sandwiched between the respective end and side panel at each of the four corners of the assembled container.

12 Claims, 3 Drawing Sheets

DIVIDED STORAGE SYSTEM

CROSS-REFERENCE TO RELATED APPLICATION

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention pertains to collapsible file systems and particularly to collapsible containers that include file dividers.

2. Relevant Art

A wide variety of containers and file dividers are known to the prior art. What is desired is a collapsible container and collapsible file divider assembly that can be folded to provide a substantially flat package for shipment and storage.

BRIEF SUMMARY OF THE INVENTION

In one aspect of the present invention there is provided a divided storage system comprising a collapsible container and a collapsible divided file assembly, the container including a planar blank having a centrally-located bottom panel with four side portions, four side panels each foldably attached to a respective one side portion and movable to a position perpendicular to the bottom panel, fastener means carried by each side panel for attaching side panels together to define an interior space, the file assembly including a first and second file each locatable adjacent to the side panel and removably attachable thereto. The file assembly includes a plurality of file dividers located between the first and second files. A plurality of accordion pleats is used for attaching one file divider to an adjacent file divider. The file assembly includes a first and second file accordion pleats for attaching respective first and second files to respective adjacent one side panel. The first and second files include side panel members for attaching them to respective adjacent side panels. Alternatively, each first and second file accordion pleats each include a side panel member for attaching first and second files to respective adjacent side panels.

In another aspect of the present invention, there is a divided storage system comprising a collapsible container and a collapsible divided file assembly, the container including a planar blank having a central bottom panel having a pair of spaced substantially parallel first side edge portions and a pair of spaced substantially parallel second side edge portions, each first edge portion being substantially perpendicular to the second edge portions, a pair of end panels each having an outside edge portion and an inside edge portion adjacent one respective first edge portion of the bottom panel. A pair of side panels each have an outside edge portion and an inside edge portion closely adjacent a respective second side edge portion of the bottom panel and being foldably connected to the bottom panel. Each end panel has substantially parallel side edge portions and a pair of elongate tabs, each tab being foldably connected closely adjacent a respective side edge portion of respective end panel. Each tab carries at least one first fastener and at least one second fastener is carried on each end panel adjacent the outside edge portion of the end panel. The fasteners cooperating to connect at least one first fastener to at least one second fastener to attach the tabs to respective end panel to define an interior space of the container. The divider file assembly being located in the interior space and attachable to the container.

The divider file assembly includes a plurality of vertically disposable files, including a first file locatable closely adjacent one end panel and having spaced elongate edge portions, each edge portion of the first file including at least one passageway therethrough and aligned with one respective at least one first and second fasteners. Each edge portion of the first file is sandwiched between respective tab and respective end panel for securing the divider file assembly to the container when the respective fasteners are secured together. The divider file assembly further includes a second file locatable closely adjacent another end panel having spaced elongate edge portions. Each edge portion of the second file includes at least one passageway therethrough and aligned with another respective pair of at least one first and second fasteners. Each edge portion of the second file being sandwiched between another respective tab and another respective end panel for securing the divider file assembly to the container when another respective fasteners are secured together.

Each file includes a first and second side edge portion and a pair of first vertically elongated panels each attached to respective first and second side edge portion of the file and a pair of second vertically elongated panels each attached between one first panel of one file and another first panel of another adjacent file. Alternately, the assembly includes a pair of spaced accordion members, the file dividers mounted between the accordion members. The divider file assembly is collapsible to locate each file substantially flat against an adjacent file. Additionally a top cover is provided for covering the container which includes a top panel having four sides and a wall subtending from each side for defining an interior space sized to house the divider file therein when the assembly is collapsed.

In a further aspect of the present invention there is provided a divided storage system comprising a collapsible container and a collapsible divided file assembly, the container including a planar blank having a centrally-located bottom panel with four side portions, front and rear panels and two side panels each foldably attached to a respective one side portion of the bottom panel and movable to a position perpendicular to the bottom panel, fastener means carried by each panel for attaching the adjacent side panels together to define an interior space. The file assembly includes planar front and rear files having opposite edge portions locatable adjacent to respective front and rear panel, respective edge portions being removably attachable thereto. The file assembly includes a plurality of file dividers located between the front and rear files. A plurality of accordion pleats is provided for attaching one file divider to an adjacent file divider and to attach the front and rear files to adjacent the file dividers. The file assembly includes a first and second pair of file accordion pleats for attaching respective edge portions of the front and rear files to respective side panels.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 1:
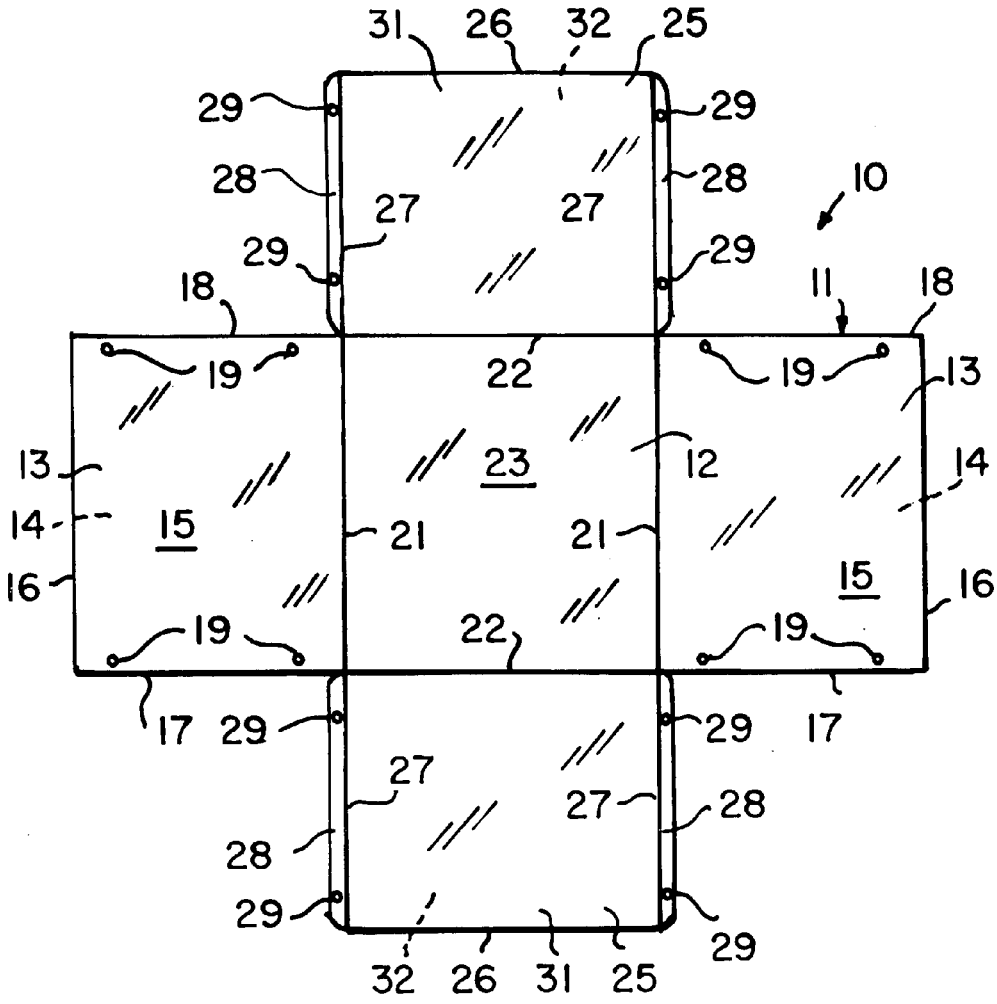
FIG. 1 illustrates a plan view of the blank and fastener assembly used to form a collapsible divided storage system in accord with the present invention.

With respect to the present invention, the blank and fastener assembly used to form the container in accord with the present invention is shown in FIG. 1 at numeral 10. The blank 10 includes a single translucent plastic blank 11 formed to define a bottom panel 12 having interior surface 23, front and rear end panels 13 and side panels 25. Each front and rear panel 13 has an outside surface 14, an inside surface 15, upper edge portion 16 and first and second side edge portions 17, 18 and is separated from and foldable about bottom panel 12 by score lines 21.

Score lines 22 provide for the folding of said panels 25 upward with respect to bottom panel 12.

Each side panel 25 has an upper edge portion 26 and interior and exterior surfaces 31, 32 and a pair of elongate tabs 28 which are foldable about score lines 27. A first set of fasteners 29 mounted on tabs 28 cooperate with a second set of fasteners 19. Fasteners 19, 29 may be snap fasteners, cam locks and any similar fasteners that can secure file dividers therebetween as will be discussed hereinbelow. Posts 30 may be integral to either fastener 19 or 29.

Figure 2:
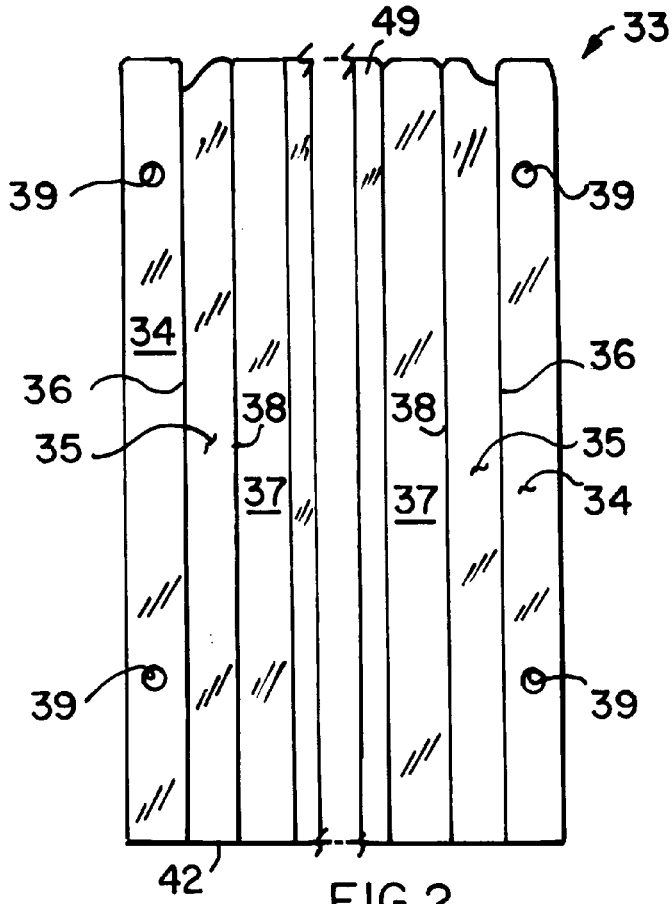
FIG. 2 is a partial elevation view of the file divider connectable to the container in accord with the present invention.
Figure 6:
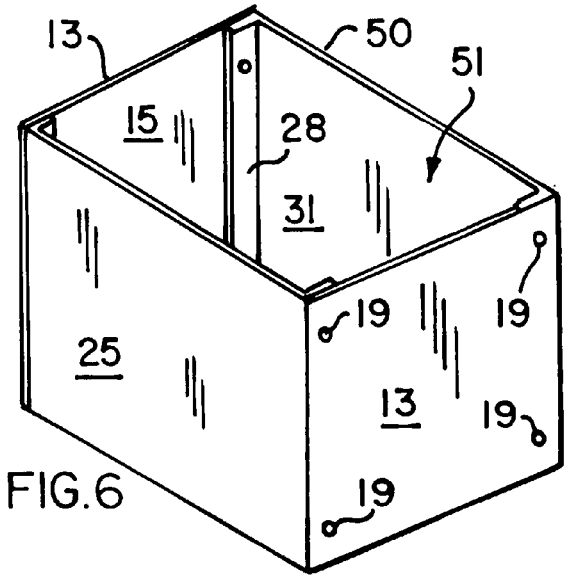
FIG. 6 is a perspective view of the blank and fastener assembly of FIG. 1.

With respect to FIG. 2, an elevation view of the first file divider of an assembly 33 is shown. Outside elongate tabs 34 have a pair of vertically spaced fastener holes 39 by which the assembly 33 is attached to the container 50 (FIG. 6). Tabs 34 are attached at fold line 36 to adjacent elongate panels 35, 37 that are foldable about fold line 38 in an accordion-like manner. Each file divider 49 has an upper index tab 41 (FIG. 4) and a lower edge 42 that forms an open bottom with an adjacent, spaced away divider 49. Items filed will rest on bottom panel inner surface 23. Each file divider 49 also includes elongate panels 35 and 37 that form an accordion pleat. Accordion member 20 is made of all the pleats as an integral member.

Figure 3:
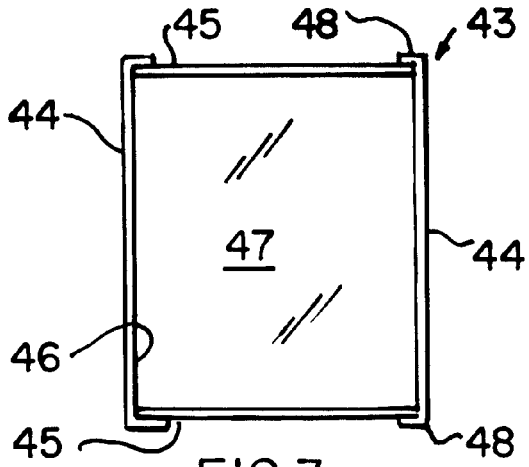
FIG. 3 is a top view of the cover of the container in accord with the present invention; and in accord with the present invention.

FIG. 3 illustrates the cover 43 used with the assembled container. Side walls 44 and end walls 45 are integral with top wall 47. Lip 48 of side walls 44 wraps to respective end wall 45 and are preferably permanently affixed although snap fasteners may be used if appropriate in the circumstances.

Figure 4:
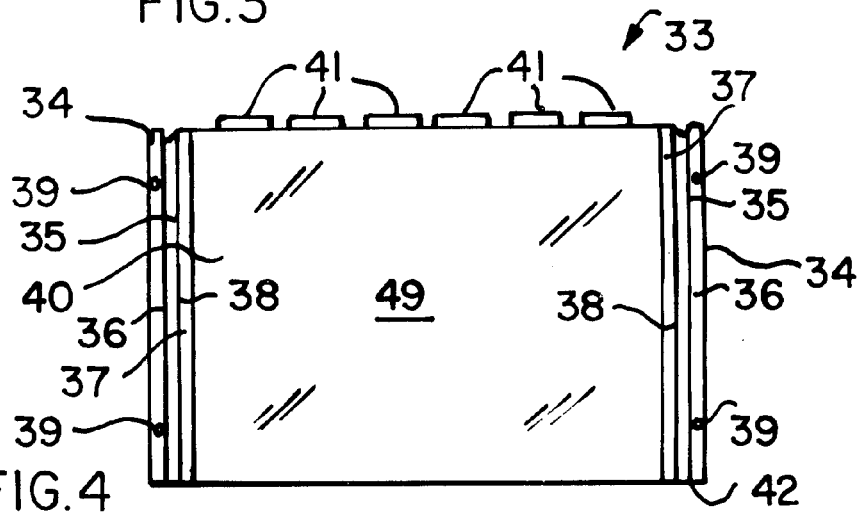
FIG. 4 is a top view of the file divider assembly folded in an accordion-like manner assembled to form the container in accord with the invention.

FIG. 4 illustrates the file divider assembly 33 folded flat for fitting into the interior space 46 in an inverted cover 43 for storage and shipping in the minimum amount of space.

Figure 5:
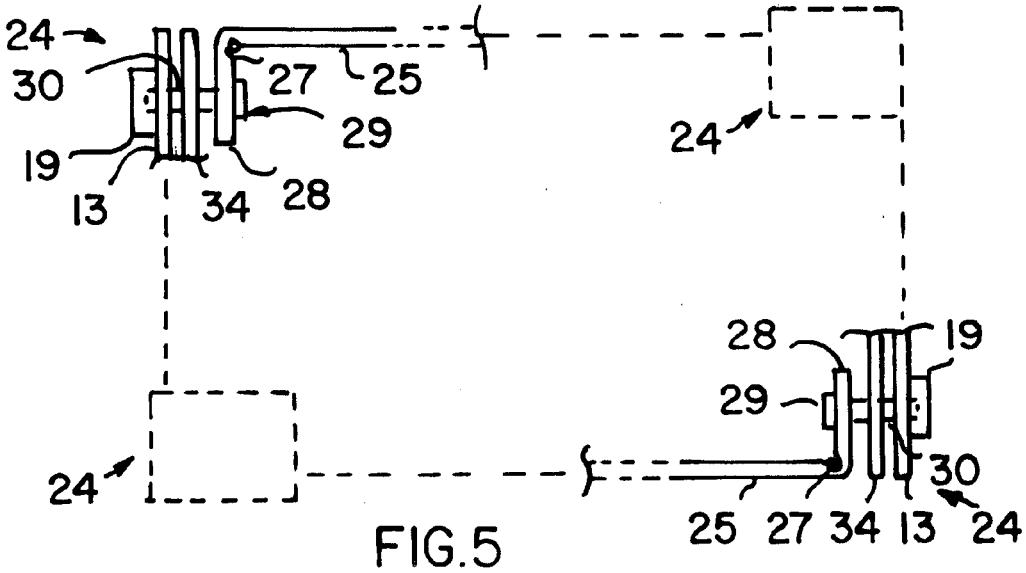
FIG. 5 is an enlarged partial top view of the connection apparatus used to attach a connectable file divider of FIG. 2 to the container in accord with the present invention.

FIG. 5 illustrates a detail of how a tab 34 of the file divider is attached to the container 50 during assembly. For purpose of illustration, the connection apparatus is shown collectively at numeral 24. The front and rear panels 13 and side walls 25 are connected at four corners as shown but details are shown at only two corners for ease of illustration.

Tabs 34 are sandwiched between tabs 28 of side panels 25 and the front and rear panels 13 with fasteners 19 and 29 with post members 30 fitting through respective passageways 39.

An assembled container 50 is shown in FIG. 6 and defines interior space 51 into which file divider assembly 33 fits.

Figure 7:
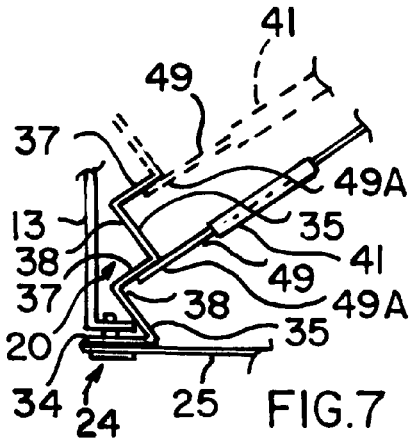
FIG. 7 is a partial top view of the connection of the file divider assembly of FIG. 4 to the assembled container.

FIG. 7 illustrates a more detailed construction of the file divider assembly 33 is constructed in a manner similar to an accordion file. An elongate panel 37 is attached to an outside side edge portion 49A of a file 49. Another elongate panel 35 is attached to one edge of a panel 37. Preferably, all the pairs of panels 35 and 37 are constructed as an accordion pleat foldable along fold lines 38 to form a plurality of accordion pleats to which each file 41 is attached to construct the assembly 33. It is to be understood that alternative construction techniques may be employed to achieve the features of the file assembly.

The precise dimensions and shape (square (FIG. 1), rectangular (FIG. 6), etc.) of the files 49, assembly 33 and container 50 will vary with the specific uses contemplated. Furthermore, cover 43 is sized to provide an interior space 46 sufficient to carry the collapsed assembly 33 and collapsed and folded blank 11 for storage and shopping purposes.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. A divided storage system comprising a collapsible container and a collapsible divided file assembly, said container including a planar blank having a centrally-located bottom panel with four side portions, four side panels each foldably attached to a respective one said side portion and movable to a position perpendicular to said bottom panel, fastener means carried by each said side panel for attaching said side panels together to define an interior space, said file assembly having an open bottom and an open top and including a first and second file divider locatable respectively adjacent to said side panels and removably attachable thereto said first and second file dividers extending substantially between said side panels said file assembly including a plurality of intermediate file dividers located between said first and second file dividers, a plurality of vertically disposed accordion pleats for attaching one said file divider to an adjacent said file divider.

2. The system as defined in claim 1 wherein said plurality of vertically disposed accordion pleats includes a first and second vertically disposed accordion pleats for attaching respective first and second file dividers to respective said adjacent one side panel.

3. The system as defined in claim 1 wherein said first and second dividers include vertically disposed elongate tabs for attaching said first and second file dividers to respective said adjacent side panels.

4. The system as defined in claim 2 wherein each said first and second accordion pleats include a vertically disposed side member for attaching said first and second dividers to respective said adjacent side panels.

5. A divided storage system comprising a collapsible container and a collapsible divided file assembly, said container including a planar blank having a central bottom panel having a pair of spaced substantially parallel first side edge portions and a pair of spaced substantially parallel second side edge portions, each said first side edge portion being substantially perpendicular to said second side edge portions, a pair of end panels each having an outside edge portion and an inside edge portion adjacent one respective said first side edge portion of said bottom panel, a pair of side panels each having an outside edge portion and an inside edge portion closely adjacent a respective said second side edge portion of said bottom panel and being foldably connected to said bottom panel, each said end panel having substantially parallel side edge portions, a pair of elongate tabs, each tab being foldably connected closely adjacent a respective said side edge portion of respective said end panel, at least one first fastener affixed to and carried by each said tab, at least one second fastener affixed to and carried on each said end panel adjacent said outside edge portion of said end panel, said fasteners cooperating to connect said at least one first fastener to said at least one second fastener to attach said tabs to respective said end panel to define an interior space of said container, said divider file assembly having an open bottom and an open top and being located in said interior space and attachable to said container, said divider assembly dividing said interior space into separate spaces between said side panels and generally between said outside edge portion of each said pair of side panels and said bottom panel, said divider file assembly includes a plurality of vertically disposable file dividers, including a first file divider locatable closely adjacent one said end panel having spaced elongate edge portions, each said edge portion of said first file divider including at least one passageway therethrough and aligned with one respective said at least one first and second fasteners, each said edge portion of said first file divider being sandwiched between respective said tab and respective said end panel for securing said divider file assembly to said container when said respective fasteners are secured together through said at least one passageway, said assembly including a pair of spaced vertically disposed accordion members, said file dividers being mounted to and between said accordion members.

6. The system as defined in claim 5 wherein said divider file assembly further includes a vertically disposed second file divider locatable closely adjacent another said end panel having spaced elongate edge portions, each said edge portion of said second file divider including at least a second passageway therethrough and aligned with another respective pair of said at least one first and second fasteners, each said edge portion of said second file divider being sandwiched between another respective said tab and another respective said end panel for securing said divider file assembly to said container when said another respective fasteners are secured together through said at least second passageway.

7. The system as defined in claim 5 wherein each said file divider includes a first and second vertically disposed side edge portion and a pair of first vertically elongated panels each attached to respective said first and second side edge portion of said file divider, and a pair of second vertically elongated panels each attached between one said first panel of one said file and another said first panel of another adjacent said file.

8. The system as defined in claim 5 wherein said divider file assembly is collapsible to locate each file divider substantially flat against an adjacent file divider.

9. The system as defined in claim 8 further including a top cover for covering said container.

10. The system as defined in claim 9 wherein said cover includes a top panel having four sides and a wall subtending from each side for defining an interior space sized to house said divider file therein when said assembly is collapsed.

11. A divided storage system comprising a collapsible container and a collapsible divided file assembly, said container including a planar blank having a centrally-located bottom panel with four side portions, front and rear panels and two side panels each foldably attached to a respective one said side portion of said bottom panel and movable to a position perpendicular to said bottom panel, fastener means carried by each said panel for attaching said adjacent side panels together to define an interior space, said file assembly having an open top and an open bottom including planar vertically disposed front and rear file dividers having opposite edge portions locatable adjacent to respective said front and rear panels respective said opposite edge portions being removably attached to said front and rear panels with said file dividers extending substantially across said interior space, said file assembly including a plurality of vertically disposed file dividers located between said front and rear file dividers, a plurality of vertically disposed accordion pleats for attaching one said file divider to an adjacent said file divider and to attach said front and rear file dividers to adjacent said file dividers.

12. The system as defined in claim 11 wherein said plurality of accordion pleats includes a first and second pair of vertically disposed file accordion pleats for attaching respective said edge portions of said front and rear file dividers to respective said side panels.

* * * * *